United States Patent [19]

Hara et al.

[11] 4,069,050

[45] Jan. 17, 1978

[54] IMAGE FORMING PROCESS

[75] Inventors: Hiroshi Hara; Hideyuki Kusaba, both of Minami-ashigara, Japan

[73] Assignee: Fuji Photo Film Co., Ltd., Minami-ashigara, Japan

[21] Appl. No.: 713,552

[22] Filed: Aug. 11, 1976

[30] Foreign Application Priority Data

Aug. 11, 1975 Japan ..... 50-97250

[51] Int. Cl.[2] ..... G03C 5/32; G03C 7/16

[52] U.S. Cl. ..... 96/60 R; 96/60 BF; 96/22; 96/66 R; 96/66.3; 96/114

[58] Field of Search ..... 96/22, 55, 60, 114, 96/66 R

[56] References Cited

U.S. PATENT DOCUMENTS

| | | | |
|---|---|---|---|
| 3,582,322 | 6/1971 | Edens | 96/22 |
| 3,765,891 | 10/1973 | Travis | 96/55 |
| 3,776,730 | 12/1973 | Matejec | 96/55 |
| 3,822,129 | 7/1974 | Dunn et al. | 96/22 |
| 3,841,873 | 10/1974 | Mowrey | 96/22 |
| 3,846,130 | 11/1974 | Purol | 96/22 |
| 3,923,513 | 12/1975 | Evans | 96/64 |
| 3,948,659 | 4/1976 | Yamaguchi | 96/60 R |

*Primary Examiner*—Mary F. Kelly
*Attorney, Agent, or Firm*—Sughrue, Rothwell, Mion, Zinn and Macpeak

[57] ABSTRACT

An image-forming process which comprises, upon conducting intensification of images using an intensifier containing at least one intensifying agent selected from the group consisting of peroxides, halogenous acids and cobalt (III) complex compounds, on a color photographic element comprising a support having at least one silver halide emulsion layer in the presence of a reducing agent, adding a mercapto group-free and nitrogen-containing hetero ring compound and a compound represented by the following general formula having a polymerization degree of 1 - 8,000;

$$-(A)_x-(B)_y-$$

wherein A represents

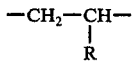

or $-CH_2-CH_2-O-$, wherein R represents

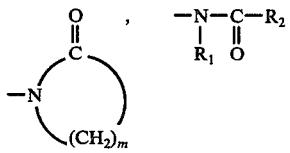

or —OH, with $m$ being an integer of 3 - 7, $R_1$ is an alkyl group having 1 to 6 carbon atoms, and $R_2$ is a hydrogen atom or an alkyl group having 1 to 4 carbon atoms, B represents a monomer unit derived from styrene, methacrylic acid ester, acrylic acid ester, vinyl acetate, acrylonitrile, vinyl alcohol, vinyl chloride, vinyl ether, acrylamide, N,N-dimethylacrylamide, acrylic acid, methacrylic acid, maleic acid, potassium styrenesulfonate, N,N-dialkylaminoalkyl methacrylate, vinyl imidazole or vinyl pyridine, and $x$ and $y$ each represents mol %, with $x + y = 100$ and $x \geqq 30$, said intensification being with a processing solution which permits said two compounds to be substantially copresent when forming images through intensification.

27 Claims, No Drawings

IMAGE FORMING PROCESS

BACKGROUND OF THE INVENTION

1. FIELD OF THE INVENTION

The present invention relates to an image-forming process, more particularly, to an image-forming process which controls fog generated in an intensification step and controls the influence of an intensification inhibitor.

2. DESCRIPTION OF THE PRIOR ART

There are known many processes for intensifying image formation by development and intensification processing of a silver halide light-sensitive material.

Oxidation of a p-phenylenediamine color developing agent through decomposition of hydrogen peroxide on the surface of a silver catalyst in the presence of a color former and subsequent dye formation by coupling with a color former (this phenomenon being called color intensification) are described, for example, in Friedman; *History of Color Photography,* 2nd, Ed., p.406 (1956).

Also, various other photographic processes utilizing the decomposition of peroxides on the surface of a noble metal surface are described in West German Pat. Nos. (OLS) 1,813,920, 1,950,102, 1,955,901, 1,961,029, 2,044,833, 2,044,993, 2,056,360, 2,056,359, 2,120,091, etc.

On the other hand, it has long been known that peroxides are decomposed on the surface of noble metals. Many examples are given in "Schokubai Kogaku Koza", Vol. 2 (1966, published by Chijin Shokan).

Color intensification processes using cobalt comples salts on the surface of noble metals are described in, for example, Japanese Patent Applications Nos. (OPI) 9,728/73, 9,729/73, 48,130/73, 84,229/74, 84,239/74, 84,249/74, 97,614/74, 102,340/74, 102,341/74, etc.

In addition, color intensification processing using halogenous acids such as a chlorite or the like is described in Japanese Patent Applications Nos. 128,327/74 and 139,917/74.

These compounds, e.g., peroxides, halogenous acids, cobalt (III) complex compounds, etc., having an intensifying action are called intensifying agents, and a processing bath containing these intensifying agents is called an intensifying bath.

In the process of using these intensifying agents, noble metals such as silver function as catalysts. The catalytic activity (i.e., intensifying effect) of the noble metals is seriously deteriorated by poisoning with compounds of ions which strongly adsorb onto the surface of the catalysts. For example, "Shokubai Kogaku Koza", Vol. 2, pp.272 – 296 (published by Chijun Shokan in 1966) describes that the decomposition of peroxides on noble metals is inhibited by $H_2S$, HCN, $HgCl_2$, $Hg(CN)_2$, $I_2$, $NH_2OH$, $C_6H_5NH_2$, etc. These compounds also inhibit intensification with halogenous acids on a catalyst like metallic silver.

In the step of developing silver halide photographic light-sensitive materials, the intensifying effect of halogenous acids and peroxides is inhibited. This inhibition might be due to bromide ion or iodide ion, being released from silver halide during developing a photographic light-sensitive silver halide material and adsorbed on the surface of silver deposits to exhibit a catalyst poisoning effect.

Further, in order to prevent fog, raise the contrast of photographic materials and maintain the activity of a solution for continuous use at a definite level, bromide ion is often added to a developer in a proportion of about 0.1 – 10 g/liter. The bromide ion can be carried into an intensifying bath to cause a catalyst poisoning effect. Oxidation of a reducing agent (e.g., color developing agent, etc.) with an intensifying agent on the thus poisoned catalytic silver is so inhibited that an effective intensifying effect cannot be achieved. Such compounds are referred to as intensification-depressing compounds.

In the case of using cobalt (III) complex salt, the intensifying effect is depressed by a mercapto group containing compound or by iodine as is described in Japanese Patent Application (Laid Open) 9,728/73.

Since an intensifying agent causes oxidation of a reducing agent on only a slight amount of metallic silver catalyst, it is practically preferred to conduct the processing in a short time. Since a color developing agent incorporated in a film of color light-sensitive material with a developer is oxidized in a subsequent intensifying solution, a slow oxidation reaction would permit the color developing agent in the film to diifuse into the intensifying solution, resulting in an insufficient color density.

The above-described three intensifying agents satisfy this requirement, and intensifying solution thereof snow high activity. Therefore, fog is liable to be produced in non-image areas also. It may thus be considered one could control fogging by an antifogging agent being present in the step of oxidizing a reducing agent (e.g., color developing agent, etc.) by an intensifying agent on a catalyst.

In this case, however, not all known antifogging agents are effective, and effective ones are limited to those which have a specific structure. Further, the presence of such antifogging compounds promotes the poisoning action of compounds which poison the aforesaid catalysts (intensification-depressing compounds) or of ions, as compared with the case where such antifogging agents are absent, the intensifying effect thus being seriously inhibited.

SUMMARY OF THE INVENTION

One object of the present invention is to provide an image-forming process using a light-sensitive material suited for image intensification.

Another object of the present invention is to provide an image-forming process capable of depressing color intensification fog and the influence of intensification inhibitors.

A further object of the present invention to provide an image-forming process using a silver-saving photographic element comprizing an image-forming unit layer (or layers) wherein the amount of light-sensitive silver halide associated with a coupler is less than the stoichiometric amount of silver halide required to react with the coupler (most preferably, the coupler is present in an amount of at least about 40 mol% in excess of the stoichiometric amount based on the silver halide), whereby color intensification fog and the influence of intensification inhibitors are controlled.

These objects of the present invention are attained by an image-forming process which comprises conducting intensification of images in a color light-sensitive element (comprising a support having at least one silver halide emulsion layer) by at least one intensifying agent selected from the group consisting of perxides, halogenous acids and cobalt (III) complex compounds in the presence of a reducing agent, and, if necessary, a color former, in the further presence of a mercapto group-free, nitrogen-containing hetero ring compound and in the further presence of at least one compared represented by the following general formula:

$$-(A)_x-(B)_y-$$

$$x + y = 100 \text{ mol } \%$$

$x \geqq 30$ mol %, and $y$ can be 0 to $\leqq$ 70 mol % (in the situation where one has a copolymer, of course, the following holds: $0 \leqq y \leqq 70$ mol %); polymerization degree = 1 to 8000 wherein A represents $$-(CH_2-\underset{\underset{R}{|}}{CH})-$$

or $-(CH_2-CH_2-0)-$ (wherein R represents

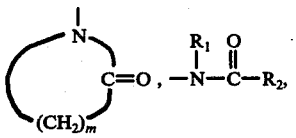

or —OH, with $m$ being an integer of 3 to 7, $R_1$ an alkyl group having 1 to 6 carbon atoms, and $R_2$ a hydrogen atom or an alkyl group having 1 to 4 carbon atoms), B represents a monomer unit derived from styrene, methacrylic acid ester, acrylic acid ester (whose both the methacrylate and acrylate acid esters are alkyl esters, preferably having from 1 to 12 carbon atoms in the alkyl moiety), vinyl acetate, acrylonitrile, vinyl alcohol, vinyl chloride, vinyl ether, acrylamide, N,N-dimethylacrylamide, acrylic acid, methacrylic acid, maleic acid, potassium styrenesulfonate, N,N-dialkylaminoalkyl methacrylate (wherein in the N, N-dialkyl moiety any alkyl group preferably has 1 to 6 carbon atoms and in the aminoalkyl moiety any alkyl group preferably has 2 to 4 carbon atoms), vinyl imidazole or vinyl pyridine.

DETAILED DESCRIPTION OF THE INVENTION

In the context of the present application, the term "image-forming unit" has its conventional meaning in the art. For example, in conventional color light-sensitive materials it means a coupler-containing light sensitive silver halide emulsion layer, or, alternatively, a unit comprising a light-sensitive silver halide emulsion layer and a coupler-containing emulsion layer as described in U.S. Pat. No. 3,227,550.

Specific examples of the compounds of the present invention represented by the general formula are illustrated below.

(1)

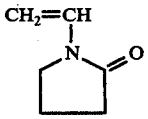

(2)

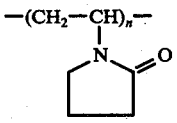

(n: 100–150)

(3)

-continued

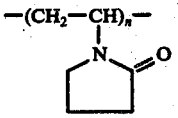

(n: 300–500)

(4)

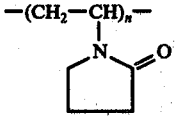

(n: 2,000–3,000)

(5)

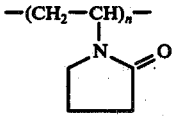

(n: 5,000–8,000)

(6)

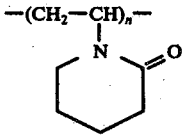

(n: 2,000–3,000)

(7)

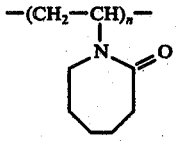

(n: 300–500)

(8)

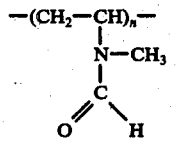

(n: 2,000–3,000)

(9)

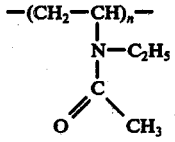

(n: 2,000–3,000)

(10)

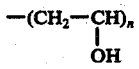

(n: 10,000–25,000)

(11)

(n: 5,000–8,000)

(12)

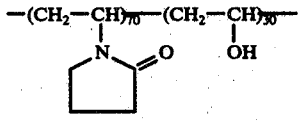

(M.W.: 20,000)

(13)

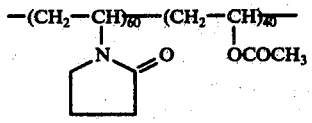

(M.W.: 50,000)

(14)

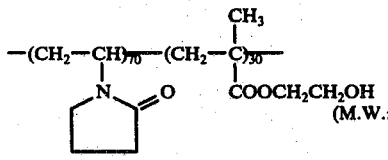

(M.W.: 30,000)

(15)

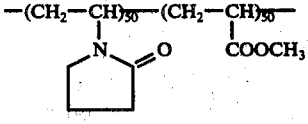

(M.W.: 30,000)

(16)

-continued

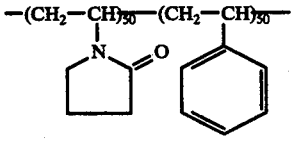

(M.W.: 50,000) (17)

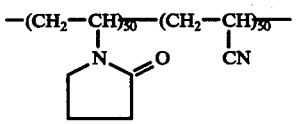

(M.W.: 40,000) (18)

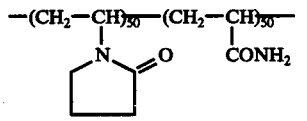

(M.W.: 20,000) (19)

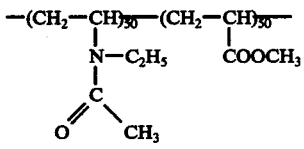

(M.W.: 50,000)

As one skilled in the art will appreciate, generally fragments of polymerization initiator or polymerization terminating agent will be attached to the terminal groups of the moiety $-(A)_x-(B)_y-$. However, in the case where the polymeric materials involved have a low degree of polymerization, the materials can form a ring compound. Accordingly, the terminal groups cannot be specified, but the following exemplary, e.g., a hydrogen atom, a hydroxy group, a phenyl group, an isobutyronitrile group, a sulfate group, etc. The terminal groups are generally not overly important since they represent such a minor part of the polymer.

Compounds of the present invention represented by the general formula are known and are described in, for example, U.S. Pat. Nos. 3,730,726, 3,770,450, 3,813,250, 3,713,829, West German Pat. No. 1,772,074, etc.

When processing steps involve a reducing agent-containing developer and an intensifier, compounds of the present invention represented by the above general formula may be used by adding them to the intensifier and/or to the developer. It is also an embodiment to conduit processing by adding the compounds to both processing solutions.

When processing steps involving a combined developing intensifying solution prepared by adding an intensifying agent to a reducing agent containing developer are employed, the compound of the present invention represented by the above general formula is used by adding it to such a combined developing intensifying solution.

The amount to be added of the compound of the present invention represented by the above general formula ranges from about 0.1 g to about 200 g, preferably 1 g to 200 g, per 1 liter of the solution. In the situation where processing is conducted by adding the compounds to both processing solutions as described above, the amount added is about 0.1 g to about 200 g per liter of each solution.

Compounds of the present invention represented by the general formula may be used alone or as combinations of two or more thereof.

Preferred examples of mercapto group-free, nitrogen-containing hetero ring compounds used in the present invention having an antifogging action are 5- or 6-membered hetero ring compounds containing 2 or more nitrogen atoms, with the preferred maximum number of nitrogen atom being 4, fused ring compounds thereof, e.g., having condensed thereto another benzene ring or a 5- or 6-membered heterocyclic ring such as pyridine, pyrazine, pyrimidine, pyridazine, pyrrole, etc. (e.g., 1, 3, 3a, 7-tetrazaindenes, benzotriazoles, benzoimidazoles, etc.), and nitrogen-containing hetero ring compounds represented by the following general formulae (I) and (II):

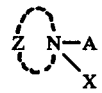

(I)

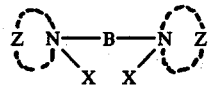

(II)

In general formulae (I) and (II), A represents a substituted or unsubstituted alkyl group, e.g., substituted with a hydroxy group, an alkoxy group having 1 to 4 carbon atoms, a carboxy group or a sulfo group, where the alkyl group per se preferably has from 1 to 10 carbon atoms, an alkenyl group, most preferably having from 2 to 10 carbon atoms, an alkynyl group, most preferably having from 2 to 10 carbon atoms, an aralkyl group, most preferably having from 7 to 12 carbon atoms, an alicyclic hydrocarbon group, most preferably having 5 to 10 carbon atoms or a substituted or unsubstituted aryl group, e.g., substituted with a hydroxy group an alkyoxy group having 1 to 4 carbon atoms or an alkyl group having 1 to 5 carbon atoms, etc., and where preferred aryl groups are mono- or di-cyclic aryl groups, and B represents a substituted or unsubstituted divalent hydrocarbon group wherein part of the carbon atoms may be replaced by hetero atoms, though no more than one half of the carbon atom present can be replaced by hetero atoms, with exemplary hetero atoms being oxygen, sulfur, nitrogen and the like. For example, B can represent a divalent group such as $$-(CH_2)_n-,\ -CH_2O-(CH_2)_n-OCH_2-,$$

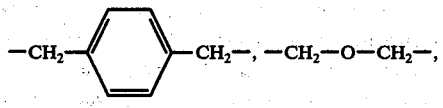

wherein $n$ represents an integer of 1 to 12 (such as preferred), X represents an anion other than $I^-$, e.g., a chloride ion, bromide ion, perchlorate ion, p-tosylate ion, hydrogen sulfate ion, nitrate ion, oxalate ion, boron tetrafluoride ion, etc., and Z represents the non-metallic atoms forming a hetero ring together with the nitrogen atom, which non-metallic atoms can comprise carbon atoms, nitrogen atoms, oxygen atoms, sulfur atoms and/or selenium atoms to thereby form a 5- or 6-membered single or condensed hetero ring, typically there being only one other non-metallic non-carbon atom forming a hetero ring together with the nitrogen atom and the balance of the atoms being carbon atoms.

More preferred examples of the above-described 5- or 6-membered hetero ring compounds containing two or more nitrogen atoms and fused ring compounds thereof are represented by the following general formulae:

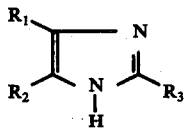

(III)

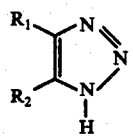

(IV)

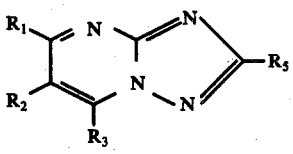

(V)

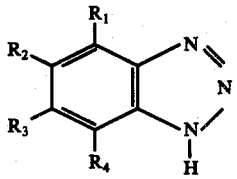

(VI)

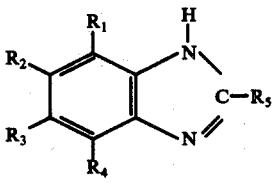

(VII)

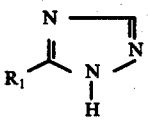

(VIII)

In the above general formulae (III)- (VIII), $R_1$, $R_2$, $R_3$ and $R_4$ each represents a hydrogen atom, an alkyl group, most preferably having 1 to 20 carbon atoms, an aralkyl group, most preferably having 7 to 12 carbon atoms, an alkenyl group, most preferably having 2 to 10 carbon atoms, an aryl group, most preferably having 6 to 12 carbon atoms, $—NH_2$, $—NO_2$, a halogen atom or —OH. When $R_1$ and $R_2$ each represents an alkyl group, they may, if desired, be connected to each other to form an aliphatic carbon ring. $R_5$ represents a hydrogen atom or an alkyl group having 1 to 5 carbon atoms.

Typical examples of such mercapto group-free, nitrogen containing hetero ring compounds of the present invention are illustrated below.

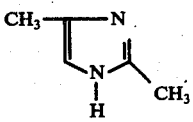

(A)

(B)

-continued

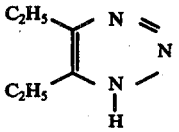

(C)

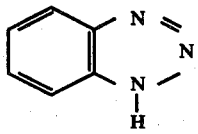

(D)

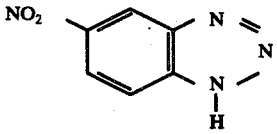

(E)

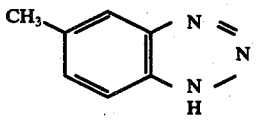

(F)

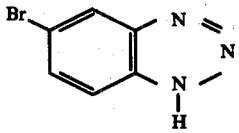

(G)

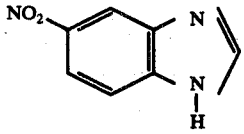

(H)

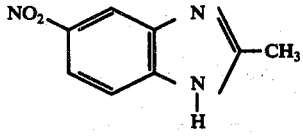

(I)

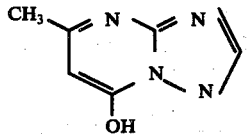

(J)

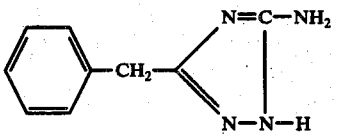

(K)

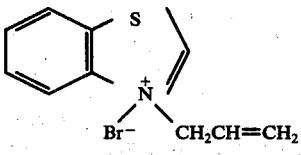

(L)

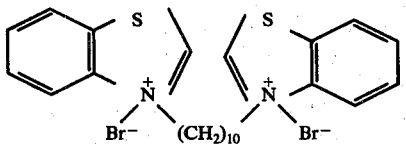

(M)

-continued

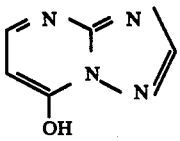

(N)

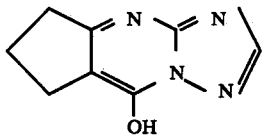

(O)

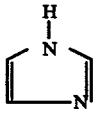

(P)

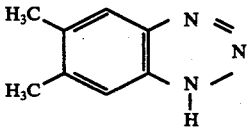

The above-described mercapto group-free, nitrogen-containing hetero ring compounds having an antifogging action are preferably added in an amount of 1 mg to 10 g, preferably 10 mg to 5 g, per 1 liter of an intensifier.

The effects of the present invention can be obtained, though in substantially reduced degree, by the addition of such nitrogen-containing hetero ring compounds having an antifogging action to a processing bath prior to an intensifier (e.g., a developing bath) or to a photographic element (e.g., an emulsion layer, a non-light-sensitive auxiliary layer, etc.).

Additionally, examples of such mercapto group-free, nitrogen-containing hetero ring compounds having an antifogging action used in the present invention are described in the following literature, etc. For example, nitrobenzimidazoles as described in U.S. Pat. No. 2,496,940, British Pat. No. 403,789, U.S. Pat. Nos. 2,497,917, 2,656,271, etc., benzotriazles as described in "Journal of Japanese Photographic Society", 11, p.48 (1948), hetero ring quaternary salts such as benzothiazolium salts are described in U.S. Pat. Nos. 2,131,038, 2,694,716, 3,326,681, etc. tetrazaindenes as described in U.S. Pat Nos. 2,444,605, 2,444,606, 2,444,607, etc., and other hetero ring compounds as described in U.S. Pat. Nos. 2,173,628, 2,324,123, 2,444,608, etc. In addition, there are those described in "Kagaku Shashin Binran", Vol. II, p.119 (1959, Maruzen).

If desired, bromide ions can be present in the intensifier of present invention, and, in fact, quite often bromide ions are carried into the intensifier of the present invention from a color developing bath.

The bromide ion may be obtained by adding to an intensifier a water-soluble bromide(s) capable of releasing bromide ion(s). For example, there are illustrated bromides of alkali metals (e.g., sodium, potassium, lithium, etc.) or of alkaline earth metals (e.g., magnesium, calcium, etc.), a bromide of the ammonium salt type (e.g., ammonium bromide), etc.

As the intensifying agents used in the present invention, there can be used peroxides, halogenous acids and cobalt (III) complex compounds. Typically, only one intensifying agent is used; however, the basic mechanism of the present invention does not prohibit utilizing one or more members from each class of intensifying agents, or, in fact, mixtures of one or more intensifying agents from two or all of these classes of intensifying agents.

Peroxides used in the present invention include inorganic peroxo compounds such as halogen peroxide, peroxoborate, peroxocarbonate, peoxophosphate, peroxosilicate, chlorine dioxide, etc., and organic peroxy compounds such as perbenzoate, etc., as are described in Friedman, *History of Color Photography*, 2nd Ed., page 406(1956), German Patent Applications (OLS) 1,813,920, 1,950,102, 1,955,901, 1,961,029, 2,044,833, 2,044,993, 2,056,360, 2,056,359 and 2,120,091, etc.

The halogenous acids are chlorous and bromous acids, as are described in Japanese Patent Applications 128,327/74 and 139,917/74. In particular, chlorous acids are preferred. Chlorous acids include chlorous acid and water-soluble chlorites. The water-soluble chlorites include chlorous acid salts of alkali metals (e.g., lithium, sodium, potassium, etc.) or alkaline earth metals (e.g., magnesium, calcium, strontium, barium, etc.), and ammonium chlorite.

As cobalt (III) complex compounds, there can be illustrated complex compounds wherein cobalt has 6 ligands. Ligands are preferably selected from amine, ethylenediamine, diethylenetriamine, triethylenetetramine, nitrate, azide, nitrite, chlorite, thiocyanate, isothiocyanate, water and carbonate. Preferred cobalt (III) complex compounds are those which contain at least 5 ammine ligands, at least 2 ethylenediamine ligands or at least 1 triethylenetetramine ligand.

The pH of the intensifying bath ranges from 7 to 14, preferably from 8 to 13. The bath can be rendered alkaline by an alkali agent or a buffer agent, etc., can be added, if desired. For example, sodium hydroxide, potassium hydroxide, sodium carbonate, potassium carbonate, sodium or potassium tertiary phosphate, potassium metaborate, borax, etc., alone or in combination. Further, for the purpose of providing buffering capability, for convenience of preparation or to raise ionic strength, there can be added various salts such as disodium or dipotassium hydrogen phosphate, potassium or sodium dihydrogen phosphate, sodium or potassium bicarbonate, boric acid, alkali nitraes, alkali sulfates, etc.

To an intensifying bath using a peroxide as an intensifying agent there may be added, as a stabilizer to raise the stability of the peroxide, compounds as described in W. C. Schumb, et. al; "Hydrogen Peroxide", pp.515–547.

To the intensifier there may be added, if desired or necessary, optional development accelerating agents. For example, various pyridinium compounds represented by those as described in U.S. Pat. No. 2,648,604, Japanese Patent Publication 9503/69 and U.S. Pat. No. 3,671,247 and other cationic compounds, cationic dyes such as phenosafranine, neutral salts such as thallium nitrate, potassium nitrate, etc., polyethylene glycol and the derivative thereof as described in Japanese Patent Publication No. 9504/69, U.S. Pat. Nos. 2,533,990, 2,531,832, 2,950,970, 2,577,127, nonionic compounds such as polythioethers, organic solvents or organic amines as described in Japanese Patent Publication No. 9509/69 and Belgian Pat. No. 682,862, accelerators as described in detail in L. F. A. Mason; "Photographic Processing Chemistry", pp.40 – 43 (Focal Press-London-1966), benzyl alcohol and phenylethyl alcohol as described in U.S. Pat. No. 2,515,147, pyridine, ammonia, hydrazine and amines as described in "Journal of the Japanese Photographic Society", Vol. 14, p.74 (1952), and the like are effective development accelerators.

Also, hydroxylamine sulfate or hydrochloride, sodium sulfite, potassium sulfite, potassium bisulfite or sodium bisulfite may be added, if desired.

Further, polyphosphate compounds as represented by sodium hexametaphosphate, sodium tetrapolyphosphate, sodium tripolyphosphate or potassium salts of the above described polyphosphates, and aminopolycarboxylic acids represented by ethylenediaminetetraacetic acid, nitrilotriacetic acid, cyclohexane/diaminetetraacetic acid, iminodiacetic acid, N-hydroxymethyl ethylenediaminetriacetic acid, diethylenetriaminepentaacetic acid, etc. may be used as a water softener. The amount of addition varies depending upon the hardness of water used, but, usually, they are used in amount of about 0.5 to about 1 g/liter, Other sequestering agents for calcium or magnesium may also be used, if desired.

The reducing agent used in the present invention is image-wise oxidized by an oxidizing agent, i.e., an intensifying agent activated on the surface of exposed silver halide or developed silver catalyst. It is to be understood, in this regard, that other catalysts can be used as are disclosed in the earlier description relating to the prior art, for example, in West German Pat. Nos. (OLS) 1,813,920, 1,950,102, 1,955,901, 1,961,029, 2,044,833,2,044,993, 2,056,360, 2,056,359, 2,120,091, in "Shokubai Kogaku Koza", Vol. 2, 1966, in Japanese Patent Applications Nos. (OPI) 9,728/73, 9,729/73, 48,130/73, 84,229/74, 84,239/74, 84,240/74, 97,614/74, 102,340/74, 102,341/74 and the like. The intensifying step is characterized by utilizing the phenomenon that an intensifying agent undergoes changes on the surface of a silver halide or developed silver catalyst to exhibit a strong oxidizing action. As reducing agents of the present invention, there are illustrated the following types. One type includes those which are oxidized to themselves become dyes. Another type includes those which are oxidized and oxidatively coupled with a color former capable of coupling (i.e., a coupler as described hereinafter) to form a dye. A further type includes those which have a diffusible dye moiety and which are image-wise oxidized to become non-diffusible. Still a further type includes those which have a non-diffusible coupler moiety capable of coupling and which are image-wise oxidized to release a diffusible coupler. In particular, reducing agents capable of oxidatively coupling with a coupler to form a dye are preferred. In this case, dyes are formed only in the presence of both the reducing agent and the coupler. In other cases, dye images can be formed by the respective reducing agents alone.

As the reducing agent used in the present invention, there are illustrated, for example, p-phenylenediamine derivative color developing agents, p-aminophenol derivative color developing agents of the onium salt type as described in U.S. Pat. No. 3,791,827, etc., dye developers as described in U.S. Pat. No. 2,983,606, diffusible dye-releasing (DDR) redox compounds as described in Japanese Patent Application (OPI) 33,826/73, developing agents capable of reacting with amidrazone compounds as described in Japanese Patent Publication 39,165/73, etc., reducing agents of the type which are themselves oxidized to form a dye or a lake (e.g., tetrazonium salt, 2,4-diaminophenol, α-nitroso-β-naphthol, leuco dye, etc.), and reducing agents capable of forming colored images after oxidation, as described in Japanese Patent Application (OPI) 6,338/72, pp. 9–13.

Particularly preferred examples of reducing agents of the present invention are p-phenylenediamine derivative color developing agents described hereinafter and p-aminophenol derivative color developing agents of the onium salt type as described in U.S. Pat. No. 3,791,827, etc. These form a dye only in the presence of a coupler.

The reducing agent used in the present invention can be used by incorporating it a processing solution and/or in a light-sensitive material. The term "processing solution"as used herein means a developer and an intensifier. In the case of incorporation in a light-sensitive material, it may be incorporated in a silver halide emulsion layer and/or a light insensitive photographic auxiliary layer. As one skilled in the art will appreciate, generally the components of a color developing solution are a developing agent and an alkali, while an intensifier generally comprises an intensifying agent and sufficient alkali to adjust the pH to 7 to 13.

Particularly preferred reducing agents used in the present invention are p-phenylenediamine derivative color developing agents. For example, N,N-diethyl-p-phenylenediamine hydrochloride, 2-amino-5-diethylaminotoluene hydrochloride, 2-amino-5-(N-ethyl-N-laurylamino)toluene, 4-[N-ethyl-N-(β-hydroxyethyl)amino]aniline sulfate, 2-methyl-4-[N-ethyl-N-(β-hydroxy-ethyl)amino]aniline sulfate, N-ethyl-N-(β-methanesulfoamidoethyl)-3--methyl-4-aminoaniline sesquisulfate monohydrate as described in U.S. Pat. No. 2,193,015, N-(2-amino-5-diethylaminophenylethyl)-methanesulfonamide sulfate as described in U.S. Pat. No. 2,592,364, N,N-dimethyl-p-phenylenediamine hydrochloride, 4-amino-3-methyl-N-ethyl-N-methoxyethylaniline as described in U.S. Pat. Nos. 3,656,950, 3,698,525, etc., 4-amino-3-methyl-N-ethyl-N-β-ethoxyethylaniline, 4-amino-3-methoxy-N-ethyl-N-62 -butoxyethylaniline, and the salts thereof (e.g., sulfates, hydrochlorides, p-toluenesulfonates, etc.) are typical preferred examples.

As reducing agents, there are further those of the type which, upon oxidation, themselves form dye images or of the type which form a complex with a metal salt. Examples of such types include developing agents as described in British Pat. No. 1,210,417, tetrazonium salts as described in U.S. Pat. No. 3,655,382, 2,4-diaminophenol. α-nitroso-β-naphthol, and the like.

The reducing agent is a compound which is oxidized with a halogenous acid, peroxide or cobalt (III) complex compound in the presence of a catalytic material but which is oxidized only at an extremely slow rate in catalyst free areas, and which per se is an image forming element or whose oxidation product has the function of forming images by reaction with a coupler.

Ordinary photographic materials contain silver salt in an amont of 3 to 10 g/m$^2$ (calculated as silver). Even print materials contain about 1 to 4 g/m$^2$ of silver. On the other hand, in the photographic material of the present invention, the amount of coated silver is not more than 5 g/m$^2$ and, in particular, if desired, it need not be more than 3 g/m$^2$. Generally speaking, more than about 1 mg/m$^2$ of silver would be used. However, with multi-layered photographic light-sensitive materials, silver is coated in an amount of not more than about 2 g/m$^2$, in particular 1 mg/m$^2$ to 1 g/m$^2$, per one light-sensitive layer.

Color formers used in the present invention are necessary in the case where images cannot be formed by the oxidized reducing agents, except for the case where the aforesaid reducing agents can form, upon oxidation, a dye or an image. That is, the color formers used in the present invention are these which couple with an oxidation product of the reducing agent to form a dye.

Preferred examples of the color former used in the present invention are compounds capable of reacting with an oxidation product of a color developing agent to form a dye, i.e., color couplers. As the color formers, there can be illustrated couplers for ordinary color light-sensitive materials, such as open-chain ketomethylene couplers, 5-pyrazolone couplers, indazolone couplers, phenol or naphthol couplers, diffusible dye-releasing (DDR) couplers as described in British Pat. No. 840,731, U.S. Pat. No. 3,227,550, Japanese Patent Application (OPI) 123,022/74, Japanese Patent Application 57,040/75, etc., amidrazone compounds as described in Japanese Patent Publication 39,165/73 capable of reacting with an oxidation product of developing agent to release a diffusible dye, and the like.

In a typical embodiment of the present invention, a color coupler is selected and incorporated in a light-sensitive material. The coupler is necessarily added in an amount sufficient to provide the desired color density in a conventional manner. Therefore, it is usually present in an equimolar amount to the existing silver or greater. As the coupler, any known one(s) may be used.

As couplers used in the present invention, there can be exemplified those as follows. Yellow couplers include, in general, open-chain ketomethylene compounds. For example, there are those described in U.S. Pat. Nos. 3,341,331, 2,875,057, 3,551,155, West German Patent Application (OLS) 1,547,868, U.S. Pat. Nos. 3,265,506, 3,582,322, 3,725,072, West German Patent Application (OLS) No. 2,162,899, U.S. Pat. Nos. 3,369,895, 3,408,194, West German Patent Application (OLS) Nos. 2,057,941, 2,213,461, 2,219,917, 2,261,361, 2,263,875, etc.

As the magenta coupler, there are mainly used 5-pyrazolone compounds. Indazolone compounds and cyanoacetyl compounds can also be used, if desired. Examples thereof are given, for example in U.S. Pat. Nos. 2,439,098, 2,600,788, 3,062,653, 3,558,319, British Pat. No. 956,261, U.S. Pat. No. 3,582,322, 3,615,506, 3,519,429, 3,311,476, 3,419,391, Japanese Patent Applications 21,454/73, 56,050/73, German Pat. No. 1,810,464, Japanese Patent Publication 2,016/69, Japanese Patent Application No. 45,971/73, U.S. Pat. No. 2,983,608, etc.

As the cyan coupler, phenol or naphthol derivatives are mainly used. Examples thereof are described in, e.g., U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892, 3,583,971, German Patent Application (OLS) 2,163,811, Japanese Patent Publication 28,836/70, Japanese Patent Application 33,238/73, etc.

In addition, couplers capable of releasing a development inhibitor upon color reaction (DIR couplers) or compounds capable of releasing a development inhibitor may be added. Examples thereof are described in U.S. Pat. Nos. 3,148,062, 3,227,554, 3,253,924, 3,617,291, 3,622,328, 3,705,201, British Pat. No. 1,201,110, U.S. Pat. Nos. 3,297,445, 3,379,529, 3,639,417, etc.

In order to satisfy the properties required for light-sensitive materials, two or more of the above-described couplers or the like may be added to the same layer, or the same compound may be added to two or more different layers.

The color formers incorporated in a unit layer of the present invention are water-insoluble color formers mixed with a solvent for the color former (preferably, a polar solvent for the color former). Typical useful solvents include tri-ocresyl phosphate, trihexyl phosphate, dioctylbutyl phosphate, dibutyl phthalate, diethyllaurylamide, 2,4-diallylphenol, liquid dye-stabilizing agents as described in *Product Licensing Index*, Vol. 83, pp.26 – 29 (March 1971), "Improved Photographic Dye Image-Stabilizing Solvents", etc. An element containing a solvent for a color former also appears to accelerate the absorption of color developer during the processing step of transferring the element from a developing bath solution to a intensifying bath.

It is convenient to select the photographic color formers so that a middle scale image is obtained. The maximum absorption band of a cyan dye formed from a cyan color former preferably lies between about 600 and 720 mm, the maximum absorption band of a magenta dye formed from a magenta color former preferably lies between about 500 and 580 mm, and the maximum absorption band of a yellow dye formed from a yellow color former preferably lies between 400 and 480 mm.

The silver halide emulsions used are conventional and usually are prepared by mixing a solution of water-soluble silver salt (e.g., silver nitrate, etc.) with a solution of watersoluble halide (e.g., potassium bromide) in the presence of a solution of a water-soluble high molecular weight polymer such as gelatin. As the silver halide, there may be used a mixed silver halide such as silver chlorobromide, silver bromoiodide, silver chlorobromoiodide, etc., as well as silver chloride and silver bromide.

The silver halide grains may be in a cubic form, an octahedral form or in a mixed crystal form thereof, and the like.

In addition, two or more silver halide photographic emulsions separately prepared may be mixed. Further, as to the crystal structure of the grains, those which are uniform to the core, those which have a stratum structure wherein the interior and the exterior are different, or conversion type silver halide grains as described in British Pat. No. 635,841 and U.S. Pat. No. 3,622,318 may be used. Also, any of those emulsions which form latent images mainly on the grain surface and internal latent image type ones which form latent images inside the silver halide grains may be used. These photographic emulsions are also described in Mees; *The Theory of the Photographic Process*, (published by MacMillan Co.), P. Glafkides; *Chimie Photographique* (published by Paul Montel in 1957), or like texts, and can be prepared according to the various known processes such as an ammoniacal process, a neutral process, an acidic process, etc.

The above-described silver halide emulsions may be chemically sensitized in a conventional manner, if desired. As the chemical sensitizing agents, there can be illustrated, gold compounds as described in U.S. Pat. Nos. 2,399,083, 2,540,085, 2,597,856, 2,597,915, etc., such as chloroaurate, auric chloride, etc., salts of noble metals such as platinum, palladium, iridium, rhodium, ruthenium, etc., as described in U.S. Pat. Nos. 2,448,060, 2,540,086, 2,566,245, 2,566,263, and 2,598,079, sulfur compounds capable of forming silver sulfide by reaction with a silver salt, as described in U.S. Pat. Nos. 1,574,944, 2,410,689, 3,189,458, 3,501,313, etc., stannous salts as described in U.S. Pat. Nos. 2,487,850, 2,518,698, 2,521,925, 2,521,926, 2,694,637, 2,983,610, 3,201,254, etc., amines amd other reducing substances.

In some cases, it is preferred to further add various additives in order to obtain desired development properties, image properties, physical film properties, and the like. As such additives, there are salt-type iodides (e.g., alkali metal iodide salts, etc.), mercapto group-containing organic compounds (e.g. phenylmercaptotetrazole, etc.), and the like. However, it is desirable not to use them in a large amount.

As generally preferred specific examples of antifogging agents to be added to a light-sensitive silver halide emulsion layer and a light-insensitive auxiliary layer of a light-sensitive element, there are hetero ring organic compounds such as tetrazoles, azaindenes, traizoles, etc.

As other additives, a photographic element may contain a hardener, a plasticizer, a lubricant, a surface agent, a glazing agent and other ones known in this field of the photographic arts.

The hydrophilic colloids used as binders can be selected from those conventionally known, if desired, e.g., there are gelatin, colloidal albumin, casein, cellulose derivatives (e.g., carboxymethyl cellulose, hydroxyethyl cellulose, etc.), sugar derivatives (e.g., agar-agar, sodium alginate, starch derivative such as water soluble hydroxyalkyl ether derivatives of starch as described in U.S. Pat. No. 3,152,906, etc.). If desired or necessary, a compatible mixture of two or more of these colloids can be used. Of these, the most generally used one is gelatin. Gelatin can be replaced, partly or wholly by other synthetic polymers such as polyvinyl alcohol, polyvinyl pyrrolidone, polyacrylates, polyacrylamides and copolymers thereof. In addition, so-called gelatin derivatives, e.g., gelatin reacted with phthalic anhydride, etc., may also be used.

The photographic emulsions can be subjected, if desired or necessary, to spectral sensitization or supersensitization using cyanine dyes such as cyanine, merocyanine, carbocyanine, etc., dyes alone or in combination, further or in combination with styryl dyes or the like. Such color sensitizing arts have long been known and are described in, e.g., U.S. Pat. Nos. 2,493,748, 2,519,001, 2,977,229, 3,480,434, 3,672,897, 3,703,377, 2,688,545, 2,912,329, 3,397,060, 3,615,635, 3,628,964, British Pat. Nos. 1,195,302, 1,242,588, 1,293,862, West German Patent Applications Nos. (OLS) 2,030,326, 2,121,780, Japanese Patent Publications Nos. 4,936/68, 14,030/69, 10,773/68, U.S. Pat. Nos. 3,511,664, 3,522,052, 3,527,641, 3,615,613, 3,615,632, 3,617,295, 3,635,721, 3,694,217, British Pat. Nos. 1,137,580, 1,216,203, etc. The exact procedure and materials used can optionally be selected according to the end use of the light-sensitive materials such as the wave-length region to be sensitized, sensitivity and the like.

The photographic element of the present invention comprises a support having provided thereon at least one silver halide emulsion layer, and, usually, a red-sensitive silver halide emulsion layer, a green-sensitive silver halide emulsion layer and a blue-sensitive silver halide emulsion layer. Alternatively, the photographic element comprises a support having provided thereon a red-sensitive silver halide emulsion layer containing a cyan image-forming coupler, a green-sensitive silver halide emulsion layer containing a magenta image-forming coupler, and a blue-sensitive halide emulsion layer containing a yellow image-forming coupler. Such a photographic element may contain light-insensitive photographic layers (e.g., an antihalation layer, an interlayer for preventing color stain, a yellow filter layer, a protective layer, etc.). As to the order of the disposition of the red-senstive layer, the green-sensitive layer and the blue-sensitive layer, there are no limits. Thus, they may be in the order of red-sensitive layer-green sensitive layer-blue-sensitive layer, blue-sensitive layer-red sensitive layer-green-sensitive layer, or red-sensitive layer-green-sensitive layer-blue-sensitive layer, from the side of the support.

Also, the photographic element of the present invention includes the case where a single emulsion layer is composed of plural unit emulsions, or other various layer structures, as is described in U.S. Pat. No. 3,726,681, British Pat. Nos. 818,687, and 923,045, U.S. Pat. No. 3,516,831, Japanese Patent Applications Nos. 5,179/75 and 42,541/75 etc.; and may be designed to be adapted for use in a color image transfer process as is described in U.S. Pat. Nos. 3,082,817, 3,185,567, 2,983,606, 3,253,915, 3,227,550, 3,227,551, 3,227,552, 3,145,633, 3,415,645, and 3,415,646, an absorption transfer process as described in U.S. Pat. Nos. 2,882,156, or a like process. When a previously dye-forming type color former or a redox dissociation type color former is used in the element, at least two color-providing units contain at least a 40% excess of the color former based on the stoichiometrical amount corresponding to silver in the layer.

The developer used in the present invention contains one or more of various developing agents (reducing agents) as described above, and, if desired or necessary, an auxiliary developing agent such as 1-phenyl-3-pyrazolidone or N,N-tetramethyl-p-phenylenediamine.

In addition, compounds known as developer ingredients may be added. As such compounds, all of the aforesaid developer ingredient compounds capable of being added to an intensifier may be used since the functions of both baths are similar.

Further, if desired or necessary, there may be added to the color developer the following ingredients.

Competitive developers such as citrazinic acid, J acid or H acid, and for example, those described in Japanese Patent Publications Nos. 9,505/69, 9,506/69, 9,507/69, 14,036/70, 9,508/69, U.S. Pat. Nos. 2,742,832, 3,520,690, 3,560,212, 3,645,737, etc.

As fogging agents such as alkali metal borohydride, amineborane or ethylenediamine, there are illustrated those described in Japanese Patent Publication No. 38,816/72, etc.

As the compensatory developing agents such as paminophenol, benzyl-p-aminophenol or 1-phenyl-3-pyrazolidone, there are illustrated those described in Japanese Patent Publications Nos. 41,475/70, 19,037/71, 19,541/71, etc.

As to the stratum structure of the element, one emulsion layer may comprise a plurality of unit emulsions or various stratum structures may be employed.

Therefore, the photographic element of the present invention usually comprises a light-sensitive silver halide emulsion layer, a light-insenstive photographic auxiliary layer a support, and the like.

The photographic support can be freely selected from those conventionally used, if desired, e.g., there are a cellulose nitrate film, a cellulose acetate film, a cellulose acetate butyrate film, a cellulose acetate propionate film, a polystyrene film, a polyethylene terephthalate film, a polycarbonate film, laminates thereof, a thin glass film, paper, etc., commonly used for photographic light-sensitive materials. Papers coated or laminated with baryta or an α-olefin polymer, in particular, polymer of an α-olefin having 2 to 10 carbon atoms such as polyethylene, polypropylene, an ethylene-butene copolymer, etc., a plastic film whose surface has been roughened to improve its adhesivity to other polymer substances as described in Japanese Patent Publication No. 19,068/72 and like supports can also provide good results.

As suitable supports, transparent or opaques one can be selected depending upon the end use of the light-sensitive material. Also, with transparent supports, not only colorless transparent ones but transparent supports colored by adding dyes or pigments can be used as well. Such have heretofore been used in X-ray films, as is described in *J. SMPTE,* 67, p.296 (1958), etc.

Opaque supports include essentially opaque ones like paper and, in addition, ones prepared by adding dyes or pigments such as titanium oxide to a transparent film, a plastic film surface-treated according to the method described in Japanese Patent Publication 19068/72, papers or plastic films to which carbon black, a dye or the like has been added to render them completely light-intercepting, and the like. Where adhesive force between the support and the photographic emulsion layer is insufficient, one can provide a subbing layer as a layer having good adhesion for both the support and the photographic emulsion layer. Also, in order to more improve adhesiveness, the surface of the support can be subjected to a preliminary processings such as a corona discharge, an irradiation with ultraviolet rays, a flame treatment, etc.

The photographic element of the present invention comprises a support having provided thereon a dye image-providing unit layer or layers. Multi-color photographic elements have at least two of the aforesaid dye image-providing unit layers, which record spectral light in different portions. The unit layers contain a light sensitive silver salt, which generally is sensitive to a specific spectral region when exposed to light and is combined with a photographic color former. Color-providing layers are effectively spaced from each other by a barrier layer, a spacer layer, a layer containing a development oxidation product scavenger, or a like layer in order to prevent color staining between dye image-providing unit layers.

Methods for effectively spacing unit layers are known in the art, and are applied to many commerical color products so as to prevent stain. Also, a light-sensitive material having a development stain-preventing layer as described in U.S. Pat. No. 3,737,317, Japanese Patent Applications 73,445/73, 113,633/73, etc., can be used in the present invention.

Photographic element layers practically used in the present invention may be coated by various conventional coating processes including dip coating, air knife coating, curtain coating and extrusion coating using a hopper as described in U.S. Pat. No. 2,681,294.

If desired, two or more layers may be coated at the same time according to the process described in U.S. Pat. Nos. 2,761,791, 3,508,947, and British Pat. No. 837,095. Also, the processes described in U.S. Pat. No. 3,087,817, etc., can be used.

The amount of compensatory developing agent(s) added is usually about 0.01 to about 1.0 g/liter.

Typical examples of the color developers comprising the above-described various components are shown in "Kagaku Shashin Binran", p.72 (Maruzen, 1959).

In one typical process belonging to the present invention, AgX color light-sensitive materials are developed, intensified (bleached and then fixed) or bleach-fixed), washed with water and dried to provide color images. Washing may be conducted before bleaching or blixing and after intensification, if desired.

In another process, a developing agent is incorporated in an emulsion layer or an adjacent layer, and a light-sensitive material is processed with an intensifier containing a peroxide, a halogenous acid and/or a cobalt (III) complex salt without processing with a developer, to thereby conduct development and intensification at the same time, and then (bleached and fixed) or bleach-fixed), washed and dried to provide color images.

In a further process, a light-sensitive material containing a developing agent in an emulsion layer or an adjacent layer is processed with an intensifier containing a fixing agent to conduct a mono-bath development/intensification/fixing, followed by rinsing and drying. As a modification thereof, it is possible to conduct a mono-bath development/intensification/stablilizing which does not require washing and rinsing.

In a still further process, couplers may be incorporated in the developer. As diffusible, non-incorporated type couplers used by adding them to a developer, there can be illustrated cyan couplers as described in, e.g., U.S. Pat. Nos. 3,002,836, 3,542,552, etc., magenta couplers as described in, e.g., Japanese Patent Publication No. 13,111/69, yellow couplers as described in U.S. Pat. No. 3,510,306, etc. In this case, couplers are used at a concentration of about 0.5 to about 5 g/liter, in particular 1 to 2.5 g/liter.

In a still further process, a light-sensitive layer and an image-receiving layer are superposed one over the other and a developer is spread therebetween to conduct development, and dyes rendered diffusible by oxidation with a chlorous acid, a peroxide and/or a cobalt (III) complex compound diffuse into the image-receiving layer. It is also possible to receive diffusible dyes reversely from the areas not oxidized.

In a color subtractive system, dye images can be formed according to a color negative process as described in "Journal of the Society of Motion Picture and Television Engineers", Vol. 61 pages 667 to 701 (1953), by W. T. Hanson and W. I. Kesner, or by using a direct positive emulsion, or through color reversal process using a negative emulsion, image-wise exposure, developing in a black-and-white developer to form a negative silver image, and exposing at least one more time (or conducting another suitable fogging processing), and subsequently developing to form the desired subtractive color dye image. In this case, bleaching is generally conducted after black-and-white development in order to prevent the first silver deposited from acting as a catalyst, and the intensifying step is provided after color development.

The processing of the present invention may be conducted at any temperature, but is usually at higher than 10° C and lower than 70° C, in particular higher than 20° C and lower than 60° C.

In the color development processing step, the intensification processing step and the color developing intensification step in various development processings, there are used a color developer, an intensifier and a color developing intensifier, respectively.

The compound of the present invention represented by the foregoing general formula and having a polymerization degree of 1 to 8,000 and the mercapto group-free, nitrogen-containing hetero ring compound having an antifogging action can be added to a color developer, an intensifier or a color development-intensifier, for example, as follows.

When the compound represented by the foregoing general formula and having a polymerization degree of 1 to 8,000 is to be added to: (1) a color developer alone, (2) both a color developer and an intensifier, or (3) an intensifier alone, the mercapto group-free nitrogen-containing hetero ring compound of the present invention having an anti-fogging action must be incorporated in the intensifier.

When the compound represented by the foregoing general formula is added to a color developing intensifier, the mercapto group-free nitrogen-containing hetero compound of the present invention having an antifogging action is incorporated at the same time in the color developing intensifier.

When the compound of the present invention represented by the foregoing general formula and having a polymerization degree of 1 to 8,000 is added to a color developer, the abovedescribed developer permeates, upon exposed multi-layered color silver halide light-sensitive material passing through the color developing bath, into photographic layers of the light-sensitive material. When the light-sensitive material impregnated with a color developer containing the compound represented by the foregoing general formula and having a polymerization degree of 1 to 8,000 is transferred to an intensifying step, intensifier containing the mercapto group-free, nitrogen-containing hetero ring compound having an antifogging action permeate into the light-sensitive material to cause image formation by intensification. During formation of images through this intensification, the above-described two compounds are both substantially present in the image-forming photographic layers of the light-sensitive material to perform their function. The term "both substantially present" includes the above-described case, the case where both compounds are previously contained in the same intensifier, or a like case.

The heretofore offered discussion will enable one skilled in the art to practice the image-forming process of the present invention with ease. However, as with most processing inventions, certain very highly preferred operational conditions exist, and these discussed below.

Firstly, the amount of intensifying agent(s) is preferably not less than about 0.03 mol/liter, more preferably from 0.25 to 17 mol/liter, and most preferably from 0.25 to 3 mol/liter.

Secondly, the amount of the reducing agent is most preferably about 1 g/liter to about 20 g/liter.

Thirdly, the amount of mercapto group free, nitrogen-containing hetero ring compound is preferably 1 mg to 10 g per liter of intensifying solution.

Fourthly, the amount of the compound of the present invention represented by the general formula is about 0.1 g to about 200 g, more preferably 1 g to 200 g per 1 liter of solution.

The present invention will now be illustrated in more detail by the following examples which, however, do not limit embodiments of the present invention in any way. Percents are by weight, unless otherwise specified.

EXAMPLE 1

A photographic element having the following stratum structure was prepared.

1. A paper support laminated with polyethylene containing dispersed therein titanium dioxide.

2. A layer on support (1), containing a silver chlorobromide emulsion (Br: 80 mol%; Ag: 100 mg/m$^2$), 1,000 mg/m$^2$ of gelatin, and 300 mg/m$^2$ of a coupler, α-pivaloyl-α-[2,4-dioxo-5,5'-dimethyloxazolidin-3-yl]-2-chloro-5-[α(2,4-di-t-amylphenoxy)-butanamido]acetanilide, dispersed in tricresyl phosphate (the coated amount of tricresyl phosphate was 150 mg/m$^2$).

3. A layer on layer (2), containing 1000 mg/m$^2$ of gelatin.

The above-described sample was exposed using a sensitometer (white light, 1,000 cms, 1 second) and subjected to the following processings.

| Processing step | Temperature | Time |
|---|---|---|
| Color development | 40° C | 1 min |
| Intensification | 40° C | 1 min |
| Washing with water | 25 – 40° C | 1 min |
| Bleach-fixing | 40° C | 1 min |
| Washing with water | 25 – 40° C | 1 min and 30 sec. |

| Color developer | |
|---|---|
| Benzyl Alcohol | 15 ml |
| Sodium Sulfite | 5 g |
| Potassium Bromide | 0.5 g |
| Hydroxylamine Sulfate | 3 g |
| 4-Amino-N-ethyl-N-(2-methoxyethyl)-m-toluidine di-p-toluenesulfonate | 8 g |
| Sodium Carbonate | 30.0 g |
| Diaminopropanoltetraacetic Acid | 10.0 g |
| Water to make | 1,000 ml (pH=10.1) |

| Bleach-fixing Solution | |
|---|---|
| Ammonium Thiosulfate | 100 g |
| Iron(III)-Ethylenediaminetetra-acetic Acid (ammonium salt) | 51 g |
| Ethylenediaminetetraacetic Acid | 3 g |
| Sodium Sulfite | 12 g |
| Water to make | 1,000 ml (pH=6.8) |

| | Intensifiers | | | | | | |
|---|---|---|---|---|---|---|---|
| | I | II | III | IV | V | VI | VII |
| $H_2O_2$ (30%) | — | 25 ml | 25 ml | 25 ml | 25 ml | 25 ml | 25 ml |
| Sodium Phosphate | 20 g | 20 g | 20 g | 20 g | 20 g | 20 g | 20 g |
| Pyrophosphoric acid (10 hydrate) | 1 g | 1 g | 1 g | 1 g | 1 g | 1 g | 1 g |
| Sodium Stannate | 0.1g | 0.1g | 0.1g | 0.1g | 0.1g | 0.1g | 0.1g |
| NaOH | 0.5g | 0.5g | 0.5g | 0.5g | 0.5g | 0.5g | 0.5g |
| Compound (2)* | — | — | — | — | — | 10 g | 10 g |
| Compound (D)* | — | — | — | 100mg | 100mg | 100mg | 100mg |

-continued

| | Intensifiers | | | | | | |
|---|---|---|---|---|---|---|---|
| | I | II | III | IV | V | VI | VII |
| KBr | | | 10mg | — | 10mg | — | 10mg |
| Water to make 1,000 ml (pH: 10.1) | | | | | | | |

*As earlier identified; hereafter reference to such compounds is also to those as earlier identified After processing, yellow density was measured. The results obtained are shown in Table 1.

Table 1

| | I | II | III | IV | V | VI | VII |
|---|---|---|---|---|---|---|---|
| Maximum Density Dmax | 1.20 | 1.90 | 1.60 | 1.90 | 1.40 | 1.85 | 1.75 |
| Minimum Density Dmin | 0.10 | 0.45 | 0.30 | 0.10 | 0.09 | 0.08 | 0.08 |

The sample processed with intensifier I showed a low Dmax and a low Dmin, since no intensifying agent had been added.

The sample processed with intensifer II prepared by adding hydrogen peroxide as an intensifying agent to intensifier I showed a Dmax increased to 1.90, thus showing a remarkable intensifying effect. However, Dmin was seriously increased.

With the sample processed with intensifier III prepared by adding 10 mg of potassium bromide, an intensification-inhibiting compound, to intensifier II, Dmax was seriously reduced due to the intensification-inhibiting action of potassium bromide, though Dmin was reduced to some extent, thus intensification being reduced.

With the sample processed with intensifier IV prepared by adding antifogging compound (D) of the present invention to intensifier II, the intensifying effect was not reduced at all, and fog was greatly reduced, thus good results being obtained. However, with intensifier V prepared by adding potassium bromide to intensifier IV, the intensifying effect was seriously reduced and Dmax was lower than in the case of using intensifier III containing no anti-fogging compound (D). Thus, it is seen that addition of antifogging compound (D) increased the inhibition of intensification by adding an intensification-inhibiting compound. Dmin was, of course, reduced.

With intensifier VI prepared by adding compound (2) of the present invention and anti-fogging compound (D), the intensifying effect was scarcely reduced, and Dmin was reduced. Further, with intensifier VII prepared by adding potassium bromide to intensifier VI, the intensifying effect was, surprisingly enough, scarcely reduced as compared with intensifier V.

The example of processing the sample with intensifier VII shows that the process of the present invention controls fog, that the intensification-inhibiting effect of an intensification-inhibiting compound is greatly reduced and that it enables one to practice an extremely stable color intensifying processing.

EXAMPLE 2

On a paper support, laminated on both sides with polyethylene containing dispersed therein titanium dioxide, were coated the following first layer (undermost layer) to the following sixth layer (uppermost layer) to prepare a color light-sensitive material containing a low amount of silver.

| | |
|---|---|
| 6th layer | gelatin (1000 mg/m$^2$) |
| 5th layer (red-sensitive layer) | AgClBr emulsion (AgBr: 50 mol%, Ag; 100 mg/m$^2$) gelatin (1000 mg/m$^2$), cyan coupler (*1) 400 mg/m$^2$, coupler solvent (*2) 200 mg/m$^2$ |
| 4th layer | gelatin (1200 mg/m$^2$), ultraviolet ray absorbent (*3) 1000 mg/m$^2$ |
| 3rd layer (green-sensitive layer) | AgClBr emulsion (AgBr: 50 mol%; Ag: 100 mg/m$^2$), gelatin (1,000 mg/m$^2$), magenta coupler (*4) 300 mg/m$^2$, coupler solvent (*5) 300 mg/m$^2$ |
| 2nd layer | gelatin (1000 mg/m$^2$) |
| 1st layer (blue-sensitive layer) | AgClBr emulsion (AgBr: 80 mol%; Ag: 150 mg/m$^2$), gelatin (1200 mg/m$^2$), yellow coupler (*6) 300 mg/m$^2$, coupler solvent (*5) 150 mg/m$^2$ |
| support | |

*1 cyan coupler: 2-[α-(2,4-di-t-amylphenoxy)butanamido]-4,6-dichloro-5-methylphenol
*2 coupler solvent: di-n-butyl phthalate
*3 ultraviolet ray absorbent: 2-(2-hydroxy-3-sec-butyl-5-t-butylphenyl)benzotriazole
*4 magenta coupler: 1-(2,4,6-trichlorophenyl)-3-[2-chloro-5-tetradecanamido]anilino-2-pyrazolin-5-one
*5 coupler solvent: tri-o-cresyl phosphate
*6 yellow coupler: α-pivaloyl-α-(2,4-dioxo-5,5-dimethyloxasolidin-3-yl)-2-chloro-5-[α-(2,4-di-t-amylphenoxy)butanamido]acetanilide.

This sample was exposed using a sensitometer (white light, 1,000 cms, 1 second), and then subjected to the following processings.

Combinations of processing solutions are shown in the following:

| Processing step | Temperature | Time |
|---|---|---|
| Color development | 40° C | 2 min |
| Intensification | 40° C | 1 min |
| Washing with water | 25 - 40° C | 1 min |
| Bleach-fixing | 40° C | 1 min |
| Washing with water | 25 - 40° C | 1 min & 30 sec |

| | Color developer | |
|---|---|---|
| | Developer A | Developer B |
| Benzyl Alcohol | 15 ml | 15 ml |
| Potassium Sulfite | 4 g | 4 g |
| Potassium Bromide | 0.5 g | 0.5 g |
| Potassium Carbonate | 30 g | 30 g |
| Hydroxylamine Sulfate | 3 g | 3 g |
| Diethylenetriamine-pentaacetic acid | 5 g | 5 g |
| 4-Amino-N-ethyl-N-(2-methoxy-ethyl)-m-toluidine di-p-toluenesulfonate | 8 g | 8 g |
| Potassium Hydroxide | 1.2 g | 1.2 g |
| Compound (1) | — | 10 g |
| Water to make | 1000 ml | (pH = 10.1) |

-continued

| | Intensifier | |
|---|---|---|
| | Intensifier VIII | Intensifier IX |
| Hydrogen peroxide (30%) | 50 ml | 50 ml |
| Sodium Secondary Phosphate (anhydrous) | 20 g | 20 g |
| Pyrophosphoric Acid (10 hydrate) | 1 g | 1 g |
| Compound (G) | — | 100 mg |
| Potassium Iodide | — | 10 mg |
| Water to make | 1000 ml (pH = 9.0) | |
| Bleach-fixing solution | | |
| Ethylenediaminetetraacetic acid (4 sodium salt) | 3 g | |
| Glacial Acetic Acid | 20 ml | |
| Ammonium Thiosulfate (70% aqueous soln.) | 130 ml | |
| Sodium Sulfite | 15 g | |
| $Co(NH_3)_6Cl_3$ | 3 g | |
| Water to make | 1,000 ml (pH = 4.3) | |

Combination of color developer and intensifying bath

| | Processing Step | | | |
|---|---|---|---|---|
| | 1 | 2 | 3 | 4 |
| Color developer | A | B | A | B |
| Intensifier | VIII | VIII | IX | IX |

The cyan, magenta and yellow densities of the samples processed according to the processing steps 1 to 4 were measured to obtain the results shown in Table 2.

Table 2

| | | Processing Step | | | |
|---|---|---|---|---|---|
| | | 1 | 2 | 3 | 4 |
| Cyan | $D^{1.0}_{0.03 logE}$ | 2.10 | 2.15 | 1.70 | 2.00 |
| density | Dmin | 0.35 | 0.30 | 0.08 | 0.08 |
| Magenta | $D^{1.0}_{0.3 logE}$ | 2.00 | 2.10 | 1.50 | 1.90 |
| density | Dmin | 0.30 | 0.25 | 0.08 | 0.08 |
| Yellow | $D^{1.0}_{0.3 logE}$ | 1.80 | 1.90 | 1.40 | 1.70 |
| Density | Dmin | 0.45 | 0.35 | 0.12 | 0.10 |

$D_{0.3logE}{}^{1.0}$ represents the optical density value on the characteristic curve at an optical density shifted to the higher exposure side from an optical density of 1.0 by 0.3 logE (criterion of contrast of gradation); greater values show a greater intensifying effect.

As is clear from Table 2, processing step 2 provides a more contrasty gradation as compared with processing step 1, showing an intensifying effect. However, the reduction of Dmin (i.e., fog control) was small, and insufficient. Also, processing step 4 of the present invention had a much less intensification-inhibiting influence as compared with processing step 3, in which the influence of potassium bromide brought from the color developer and potassium iodide in the intensifier was great. In addition, a sufficient reduction of Dmin was observed.

Thus, the excellence of the process of the present invention can be seen.

EXAMPLE 3

Onto a paper support laminated on both sides with polyethylene containing dispersed therein titanium dioxide, were coated the following 1st layer (undermost layer) to the following 6th layer (uppermost layer) to prepare a color light-sensitive material containing a low amount of silver. (In the following table, "mg/m²" stands for the coated amount.)

| | |
|---|---|
| 6th layer | gelatin (1,000 mg/m²) |
| 5th layer (red-sensitive layer) | AgClBr emulsion (AgBr: 70 mol%; Ag: 100 mg/m²), gelatin (1,000 mg/m²), cyan coupler (*1) 400 mg/m², coupler solvent (*2) 200 mg/m² |
| 4th layer | gelatin 1200 mg/m², dioctylhydroquinone 50 mg/m², ultraviolet ray absorbent (*3) 1000 mg/m² |
| 3rd layer (green-sensitive layer) | AgClBr emulsion (AgBr: 70 mol%; Ag: 100 mg/m²) gelatin 1000 mg/m², magenta coupler (*4) 300 mg/m², coupler solvent (*5) 300 mg/m² |
| 2nd layer | gelatin 1000 mg/m², dioctylhydroquinone 50 mg/m² |
| 1st layer (blue-sensitive layer) | AgClBr emulsion (AgBr: 80 mol%, Ag: 150 mg/m²), gelatin 1200 mg/m², yellow coupler (*6) 300 mg/m², coupler solvent (*7) 150 mg/m² |
| Support | |
| *1 cyan coupler<br>*2 coupler solvent<br>*3 ultraviolet ray absorbent<br>*4 magenta coupler<br>*5 coupler solvent<br>*6 yellow coupler | Same as in Example 1 |
| *7 coupler solvent: dioctylbutyl phosphate | |

This sample was exposed using a sensitometer (white light, 1,000 cms, 1 second) and subjected to the following processings.

| Processing step | Temperature | Time |
|---|---|---|
| Color development | 40° C | 1 min |
| Intensification | 40° C | 2 min |
| Washing with water | 25 – 40° C | 1 min |
| Bleach-fixing | 40° C | 1 min |
| Washing with water | 25 – 40° C | 1 min |

| | |
|---|---|
| Color developer | |
| Benzyl Alcohol | 5 ml |
| Potassium Sulfite | 4 g |
| Potassium Bromide | 0.5 g |
| Potassium carbonate | 30 g |
| Hydroxylamine Sulfate | 3 g |
| Ethylenediaminetetraacetic Acid (disodium salt) | 5 g |
| 4-Amino-N-ethyl-N-(2-methoxyethyl)-m-toluidine p-toluene sulfonate | 8 g |
| Potassium Hydroxide | 1.2 g |
| Water to make | 1,000 ml (pH = 10.1) |

| | Intensifier | | | |
|---|---|---|---|---|
| | X | XI | XII | XIII |
| $Co(NH_3)_6Cl_3$ | 10 g | 10 g | 10 g | 10 g |
| Potassium Carbonate | 7.5 g | 7.5 g | 7.5 g | 7.5 g |
| Potassium Sulfite | 2 g | 2 g | 2 g | 2 g |
| Ethylenediaminetetraacetic acid (4 sodium salt) | 10 g | 10 g | 10 g | 10 g |
| Compound (12) | — | — | 15 g | 15 g |
| Compound (C) | — | — | 0.2 g | 0.2 g |
| Potassium Iodide | — | 20 mg | — | 20 mg |
| Water to make | 1,000 ml (pH = 10.0) | | | |

| | |
|---|---|
| Bleach-fixing solution | |
| Ethylenediaminetetraacetic Acid (4 sodium salt) | 3 g |
| Glacial Acetic Acid | 20 ml |
| Ammonium Thiosulfate (70% aq. soln.) | 130 ml |
| Sodium Sulfite | 15 g |
| $Co(NH_3)_6Cl_3$ | 3 g |
| Water to make | 1,000 ml (pH = 4.3) |

After the processings, cyan, magenta and yellow densities were measured. The results obtained are shown in Table 3. Processing steps X – XIII in Table 3 correspond to the cases of using intensifiers X – XIII, respectively.

Table 3

| | | Processing Step | | | |
|---|---|---|---|---|---|
| | | X | XI | XII | XIII |
| Cyan | $D^{1.0}_{0.3 logE}$ | 1.80 | 1.50 | 1.75 | 1.70 |
| Density | Dmin | 0.15 | 0.12 | 0.11 | 0.11 |
| Magenta | $D^{1.0}_{0.3 logE}$ | 1.70 | 1.40 | 1.65 | 1.60 |

Table 3-continued

| | | Processing Step | | | |
|---|---|---|---|---|---|
| | | X | XI | XII | XIII |
| Density | Dmin | 0.14 | 0.12 | 0.12 | 0.11 |
| Yellow | $D^{1.0}_{0.3,logE}$ | 1.60 | 1.30 | 1.60 | 1.50 |
| Density | Dmin | 0.18 | 0.14 | 0.13 | 0.10 |

In this processing using a cobalt (III) complex as an intensifying agent, processing step XII of the present invention also reduced fog density. Also, with processing step XIII of the present invention, it can be seen that inhibition of intensification by potassium iodide, an intensification inhibitor, was greatly reduced. Thus, it is seen that the process of the present invention offers excellent benefits. Additionally, when similar experiments were conducted using antifogging compound (D), (E), (G) or (J) in place of antifogging compound (C) added to intensifiers XII and XIII, there were obtained substantially the same excellent effects as described above.

While the invention has been described in detail and with reference to specific embodiments thereof, it will be apparent to one skilled in the art that various changes and modifications can be made therein without departing from the spirit and scope thereof.

What is claimed is;

1. In a process involving image formation followed by photographic processing which comprises contacting an image-wise exposed color photographic element comprising a support having thereon at least one silver halide emulsion containing image-wise distributed silver catalyst nuclei with an intensifier containing at least one intensifying agent selected from the group consisting of peroxides, halogenous acids and cobalt (III) complex compounds, in the presence of a reducing agent, which is in a processing solution or the element, and thereby image-wise oxidizing the reducing agent and conducting image intensification by the oxidized reducing agent, the improvement comprising that (1) at least one compound represented by the following general formula having a polymerization degree of 1 — 8,000; $-(A)_x-(B)_y-$ wherein A represents

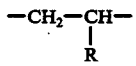

or $-CH_2-CH_2-O-$, wherein R represents

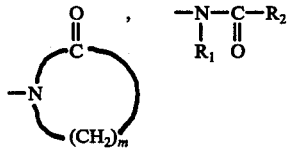

or —OH, with $m$ being an integer of 3 – 7, $R_1$ is an alkyl group having 1 to 6 carbon atoms, and $R_2$ is a hydrogen atom or an alkyl group having 1 to 4 carbon atoms, B represents a monomer unit derived from styrene, methacrylic acid ester, acrylic acid ester, vinyl acetate, acrylonitrile, vinyl alcohol, vinyl chloride, vinyl ether, acrylamide, N,N-dimethylacrylamide, acrylic acid, methacrylic acid, maleic acid, potassium styrenesulfonate, N,N-dialkylaminoalkyl methacrylate, vinyl imidazole or vinyl pyridine, and (2) an antifoggant being at least one nitrogen containing hetero ring compound having no mercapto group are both contained in said intensifier or a developing bath prior to said intensifier.

2. The process as claimed in claim 1, wherein said intensification is further conducted in the presence of a color former.

3. The process as claimed in claim 1, wherein said reducing agent is a p-phenylenediamine derivative color developing agent and said intensification is conducted in the presence of a color former which is a coupler.

4. The process as claimed in claim 1, wherein said intensifying agent is at least one member selected from the group hydrogen peroxide, peroxoborate, peroxocarbonate, a chlorite and $Co(NH_3)_6Cl_3$.

5. The process as claimed in claim 1, wherein said mercapto group-free and nitrogen-containing hetero ring compound is added to the intensifier.

6. The process as claimed in claim 1, wherein said mercapto group-free and niteogen-containing hetero ring compound is added to a processing bath prior to said intensification.

7. The process as claimed in claim 1, wherein said mercapto group-free and nitrogen-containing hetero ring compound is added in an amount of 1 mg to 10 g per 1 liter of the processing bath in which it is present.

8. The process as claimed in claim 1, wherein said mercapto group-free and nitrogen-containing hetero ring compound is a compound represented by the following general formulae:

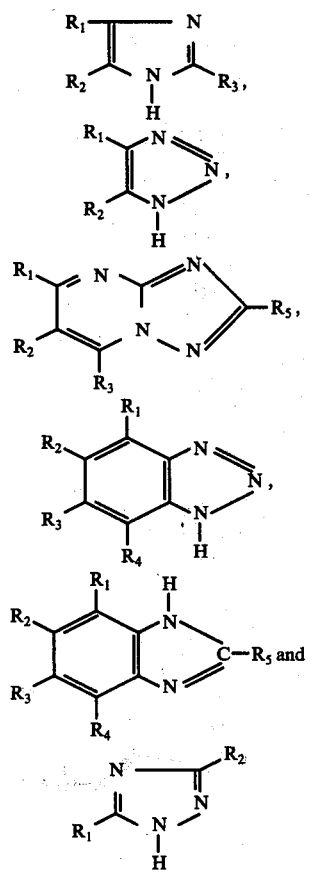

wherein $R_1$, $R_2$, $R_3$ and $R_4$ each represents a hydrogen atom, an alkyl group, an aralkyl group, an alkenyl group, an aryl group, —$NH_2$, —$NO_2$, a halogen atom or —OH, and when $R_1$ and $R_2$ each represents an alkyl group, they may be connected to each other to form an aliphatic carbon ring, and wherein $R_5$ represents a hydrogen atom or an alkyl group having 1 to 5 carbon atoms.

9. The process as claimed in claim 1, wherein said mercapto group-free and nitrogen-containing hetero ring compound is at least one compound selected from the following compounds:

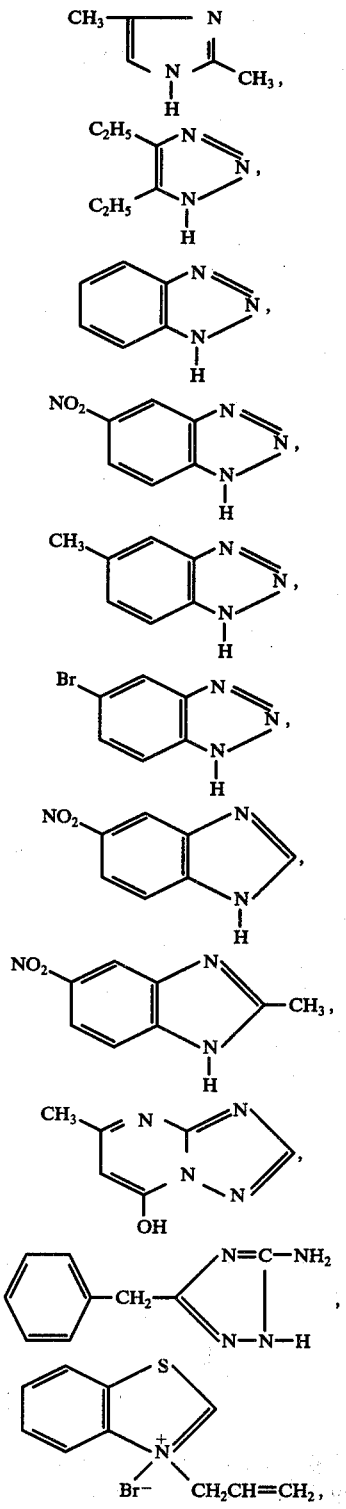

-continued

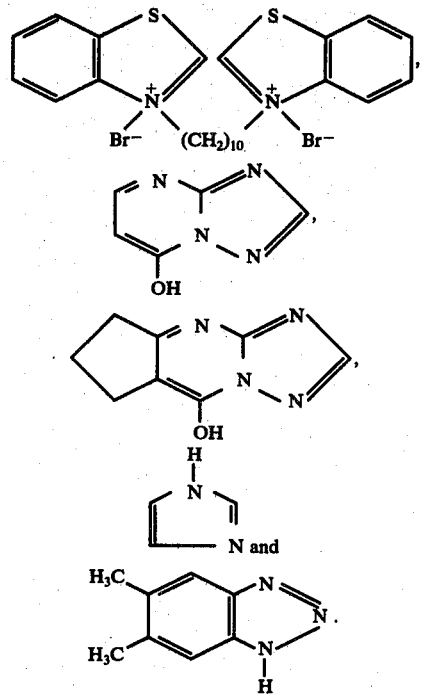

10. The process as claimed in claim 1, wherein said compound represented by the general formula $$-(A)_x-(B)_y-$$

is added to the intensifier.

11. The process as claimed in claim 1, wherein said compound represented by the general formula $$-(A)_x-(B)_y-$$

is at least one compound selected from the following compounds:

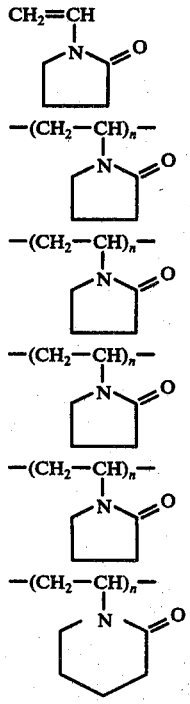

(n: 100–150), (n: 300–500), (n: 2,000–3,000), (n: 5,000–8,000), (n: 2,000–3,000),

-continued

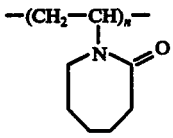

(n: 300–500),

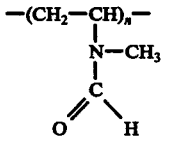

(n: 2,000–3,000),

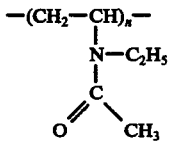

(n: 2,000–3,000),

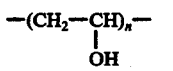

(n: 10,000–25,000),

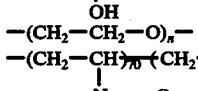

(n: 5,000–8,000),

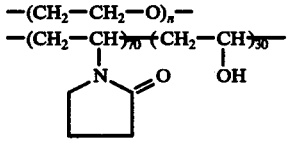

(M.W.: 20,000),

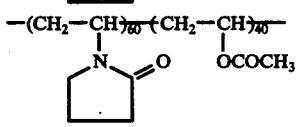

(M.W.: 50,000),

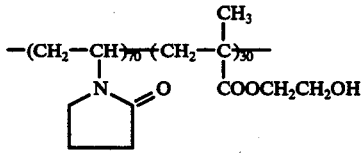

(M.W.: 30,000),

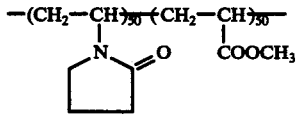

(M.W.: 30,000),

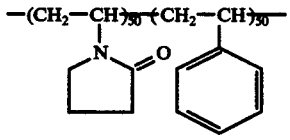

(M.W.: 50,000),

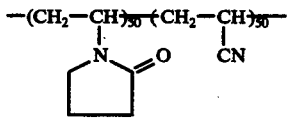

(M.W.: 40,000),

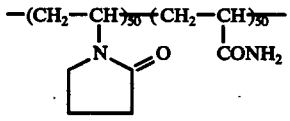

(M.W.: 20,000) and

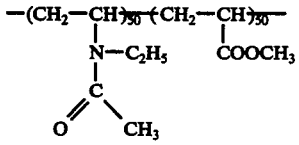

(M.W.: 50,000).

12. The process as claimed in claim 11, wherein said compound is selected from

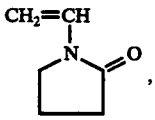

-continued

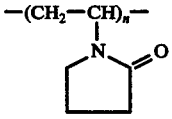

(n: 100–150) and

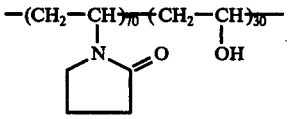

(M.W.: 20,000) .

13. The process as claimed in claim 1, wherein the amount of the compound represented by the general formula $$-(A)_x-(B)_y-$$

is added to a processing bath is about 0.1 g/liter to about 200 g/liter.

14. The process as claimed in claim 1 wherein said compound represented by the general formula $$-(A)_x-(B)_y-$$

is added to a processing bath prior to said intensifier.

15. The process as claimed in claim 14 wherein said compound represented by the general formula $$-(A)_x-(B)_y-$$

is added to a color developing bath.

16. The process as claimed in claim 10, wherein said compound represented by the general formula $$-(A)_x-(B)_y-$$

is added to a combined developing-intensifying bath.

17. The process as claimed in claim 1, wherein said color photographic element is a photographic light-sensitive silver halide element containing silver in an amount of not more than about 5 g/m$^2$.

18. The process as claimed in claim 17, wherein said color photographic element is a multi-layered photographic light-sensitive silver halide element containing silver in an amount of not more than about 2 g/m$^2$ per one light-sensitive layer.

19. The process as claimed in claim 15, wherein said color photographic element contains said coupler in an equimolar amount to the existing silver or greater.

20. The process as claimed in claim 19, wherein said intensification is conducted in the presence of a water-insoluble color coupler which has been mixed with a solvent for the coupler and incorporated in the color photographic element.

21. The process as claimed in claim 1, wherein said color photographic element comprises a support having provided thereon a red-sensitive halide emulsion layer containing a cyan image-forming coupler, a green-sensitive silver halide emulsion layer containing a magenta image-forming coupler and a blue-sensitive silver halide emulsion layer containing a yellow image-forming coupler.

22. The process as claimed in claim 1, wherein said color photographic element comprises a support having provided thereon at least one light-sensitive silver halide emulsion layer and at least one adjacent layer other than said emulsion layer.

23. The process as claimed in claim 1, wherein said reducing agent is added to a processing solution.

24. The process as claimed in claim 1, wherein said reducing agent is added to a light-sensitive element.

25. The process as claim in claim 24, wherein said reducing agent is added to an adjacent layer or an emulsion layer.

26. The process as claimed in claim 1, wherein the processing temperature is 10° to 70° C.

27. The process as claimed in claim 1, wherein the amount of intensifying agent is not less than about 0.03 mol/1.

* * * * *